United States Patent [19]

Bouchard et al.

[11] 4,432,724

[45] Feb. 21, 1984

[54] PHOTOFLASH LAMP INCLUDING IMPROVED IGNITION MEANS

[75] Inventors: Andre C. Bouchard, Peabody; Robert F. Craig, Danvers, both of Mass.

[73] Assignee: GTE Products Corporation, Stamford, Conn.

[21] Appl. No.: 353,316

[22] Filed: Mar. 1, 1982

[51] Int. Cl.[3] ..... F21K 5/00

[52] U.S. Cl. ..... 431/362; 431/358

[58] Field of Search ..... 431/358, 362, 363, 357; 313/9, 483, 222, 316; 362/3

[56] References Cited

U.S. PATENT DOCUMENTS

| | | | |
|---|---|---|---|
| 3,220,224 | 11/1965 | Baird | 431/358 X |
| 3,220,225 | 11/1965 | Baird | 431/362 |
| 3,310,968 | 3/1967 | Buzalski | 431/362 |
| 3,332,257 | 7/1967 | Gainer et al. | 431/362 X |
| 4,229,161 | 10/1980 | Bouchard et al. | 431/362 |

FOREIGN PATENT DOCUMENTS

| | | | |
|---|---|---|---|
| 2038026 | 7/1980 | United Kingdom | 431/358 |

*Primary Examiner*—Samuel Scott
*Assistant Examiner*—Randall L. Green
*Attorney, Agent, or Firm*—Lawrence R. Fraley

[57] ABSTRACT

An electrically-activated, subminiature photoflash lamp including a glass envelope, a quantity of combustible shred material (e.g., zirconium or hafnium) for providing high intensity light output upon ignition thereof, and an ignition means for igniting the combustible upon application of a suitable pulse such as typically provided by a piezoelectric element utilized in many of today's pocket-type cameras. The ignition means includes a first quantity of primer material located within a buttom of the lamp's envelope, a pair of lead-in wires secured within the bottom end of the envelope and in electrical contact with the primer, and a thin member located at an opposite end of the envelope from the first primer and having thereon a second quantity of primer material. The first primer, when ignited, thus serves to ignite a first end portion of the combustible shred material while substantially simultaneously igniting the spaced, second primer. This second primer in turn ignites the opposing end portion of the shred material such that this material burns from the opposing ends thereof toward the center to in turn assure both uniformity of burn and an accelerated rate thereof. In one example, the thin member comprised a cylindrical-shaped mica disk.

12 Claims, 2 Drawing Figures

PHOTOFLASH LAMP INCLUDING IMPROVED IGNITION MEANS

DESCRIPTION

TECHNICAL FIELD

The present invention relates to photoflash lamps and particularly to photoflash lamps which are electrically activated. Even more particularly, the invention relates to improved means for igniting such lamps.

BACKGROUND

Lamps of the above type are generally classified into two varieties: low-voltage and high-voltage. Low-voltage photoflash lamps typically include a glass envelope with a combustion-supporting gas (e.g., oxygen) and a quantity of filamentary, combustible material (e.g., shredded hafnium or zirconium) therein. A pair of electrically conductive lead wires are usually sealed in one end of the envelope and extend therein. A filament is utilized and interconnects the extending ends of the wires. When the filament is heated by a firing current usually generated from a low-voltage source such as battery or charged capacitor (e.g., having a voltage of from about 1.5 to 15 volts), it ignites a primer material which then ignites the combustible material to produce a flash of light. Naturally, the oxygen gas aids in the above ignition. In high-voltage lamps, the use of a filament is usually excluded by the provision of a glass or ceramic bead in which are located the extending ends of the lamp's conducting wires. The combustible-igniting primer material serves to bridge the portions of these ends which project through the bead. High-voltage lamps also include the aforedescribed filamentary material and combustion-supporting gas. Flashing is accomplished by a firing pulse approaching a few thousand volts and usually provided by a piezoelectric element. In another type of high-voltage lamp, the primer is located within an indentation in the bottom of the lamp and the conductive wires extend therein.

The teachings of the instant invention are particularly concerned with high voltage lamps, although it will be understood from the following that said teachings may be readily extended to lamps of the earlier generation, low voltage variety. Even more particularly, the teachings as provided herein are especially concerned with high voltage lamps wherein the primer material is located in the bottom of the lamp (e.g., along a bottom surface thereof).

Locating the lamp's primer material within a recess, cavity, indentation, etc. at the bottom end (that containing the lamp's two lead-in wires) of the envelope is particularly desirable in photoflash lamps of the subminiature variety (e.g., those having an internal volume of less than about 0.2 cubic centimeters) in view of the relatively large space required for occupancy by the lead-in wires which form part of the lamp's ignition structure (the primer material typically forming the remaining part). While this arrangement allows for the saving of precious internal volume of the lamp's envelope to thereby enable relatively larger volumes of shredded combustible therein, uniform ignition of the combustible shreds can prove somewhat difficult in that the shred mass typically burns from one end of the envelope to the other when ignited. Accordingly, various factors such as extent of compaction and final shred mass location can adversely affect the combustion rate of this mass. This in turn can adversely alter (e.g., extend) the peak output time for the ignited lamp as well as the total light output. With particular regard to peak output time, it is understood that this parameter is critical in view of the requirement that the lamp's peak output must coincide with the shutter operation of the corresponding camera utilizing a photoflash lamp of this variety.

The present invention, as will be defined, describes a photoflash lamp including a novel means of ignition for the lamp's shredded combustible material such that the combustion rate of this material is substantially increased. The invention also enables the shredded combustible material to burn in a substantially more uniform manner than typical photoflash lamps of the prior art. Although the teachings as provided herein are particularly adaptable to photoflash lamps of the electrically-activated, subminiature variety, it is understood that these teachings are also applicable to other varieties of high voltage photoflash lamps, including those containing the aforementioned ignition structure wherein a glass support bead or similar component is also used.

It is believed, therefore, that a photoflash lamp possessing the unique features as stated above would constitute a significant advancement in the art.

DISCLOSURE OF THE INVENTION

It is a primary object of the present invention to provide an electrically-activated photoflash lamp wherein ignition of the combustible material therein is accomplished at a substantially increased rate over typical photoflash lamps of the prior art and wherein the combustible material burns substantially more uniformly than said prior art lamps.

It is also another object of the present invention to provide a photoflash lamp possessing the aforementioned advantageous features yet which can be readily produced on a mass production basis and therefore at relatively low cost.

In accordance with one aspect of the invention, there is provided a photoflash lamp comprising an elongated, light-transmitting envelope, a quantity of combustible, light-producing material located within the envelope, and an ignition means for igniting the combustible, said ignition means including a first quantity of primer material located within a first end of the envelope adjacent part of the combustible material for igniting this part upon ignition thereof, a pair of lead-in wires secured within the envelope and connected electrically to the first primer for providing ignition thereof upon application of a suitable pulse (e.g., such as provided by a typical piezoelectric element presently utilized in the art) across the lead-in wires, a thin member oriented at an opposing end of the envelope from the first primer and having positioned thereon a second quantity of primer material adjacent a second part of the combustible material for igniting said second part upon being ignited by the first primer material.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
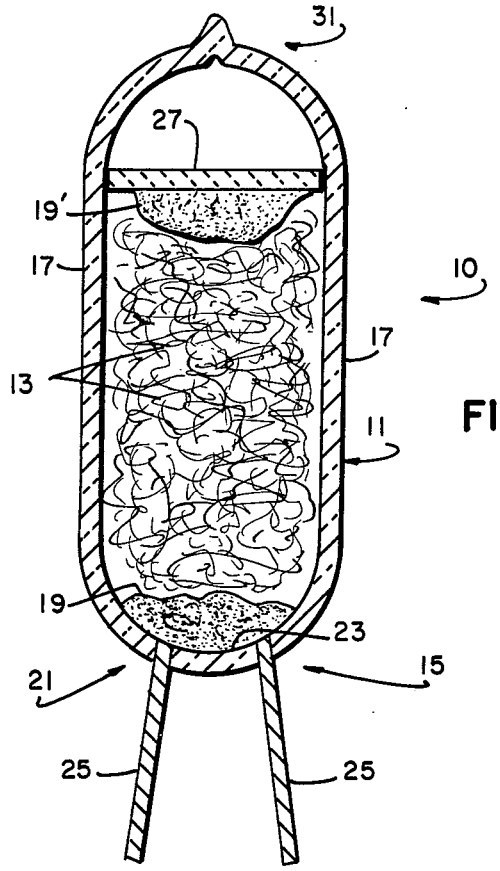
In FIG. 1, there is shown an electrically-activated photoflash lamp including an improved ignition means in accordance with a preferred embodiment of the invention.

With particular attention to FIG. 1, there is shown a photoflash lamp 10 in accordance with a preferred embodiment of the invention. Lamp 10 comprises an elongated, light-transmitting envelope 11, a quantity of combustible, light-producing material 13 positioned within the envelope, and an ignition means 15 for igniting the combustible 13. Envelope 11 is preferably of glass (e.g., lime glass), but may also be of a suitable plastic or similar insulative material. By the term light-transmitting is meant any material which permits passage of the high intensity light as typically provided from a photoflash lamp therethrough without substantially altering said output. Envelope 11, in cross-section, is preferably of substantially cylindrical configuration having an external diameter of about 0.210 inch. Each of the longitudinal side walls 17 of the envelope possess a thickness of about 0.020 inch. The total internal volume of envelope 11 is somewhat less than about 0.200 cubic centimeter, specifically, about 0.175 cubic centimeter. As stated, envelope 11 is of substantially elongated shape. In one specific example, the finished envelope (as shown in FIG. 1) possessed a total length of about 0.650 inch. This length understandably is about three times the envelope's external diameter.

Combustible, light-producing material 13 is preferably zirconium or hafnium and more preferably of shredded configuration. That is, material 13 is comprised of several individual shreds of the stated metal wherein these shreds are sheared from a sheet of thin foil. Use of shredded combustible material of the variety described is well known in the art and further description is not believed necessary. In one example of the invention, a total of approximately 12 milligrams of zirconium shreds was utilized within the lamp vessel.

Ignition means 15 comprises a first quantity of primer material 19 located within a first, bottom end 21 of envelope 11. As shown, first primer material 19 is positioned along the bottom wall 23 of end 21. In one example, a total of from about 0.500 to about 0.750 milligrams of primer was used. First primer material 19 comprised a mixture of about 80 percent by weight zirconium and about 20 percent by weight potassium perchlorate. With regard to the invention, it is to be understood that other materials such as are known in the art may be utilized. It is also within the scope of the invention to modify the percentages of those materials as defined without adversely affecting the performance of the invention. As shown in FIG. 1, ignition means 15 further includes a pair of lead-in wires 25 which are secured within the bottom end of envelope 11 in electrical contact with the first primer material 19. Sealing of each of the lead-in wires 25 can be accomplished using techniques well known in the art and further description is therefore not believed necessary. Each wire 25 is preferably of a nickel-iron alloy and possesses an external diameter of about 0.015 inch. Wires 25 are spaced apart within the bottom end 21 of envelope 11 a total distance of about 0.040 inch. Application of a suitable pulse (such as a high voltage, low energy pulse as provided by a piezoelectric element typically utilized in many of today's pocket-type cameras) results in generation of a spark between the ends of each wire which are in contact with first primer material 19. Passage of this spark through the first primer material 19 results in ignition thereof to in turn ignite the portion of the shredded combustible material 13 located immediately adjacent primer material 19. As shown, the end portions of lead-in wires 25 which contact primer material 19 are flush with interior surface 23.

Figure 2:
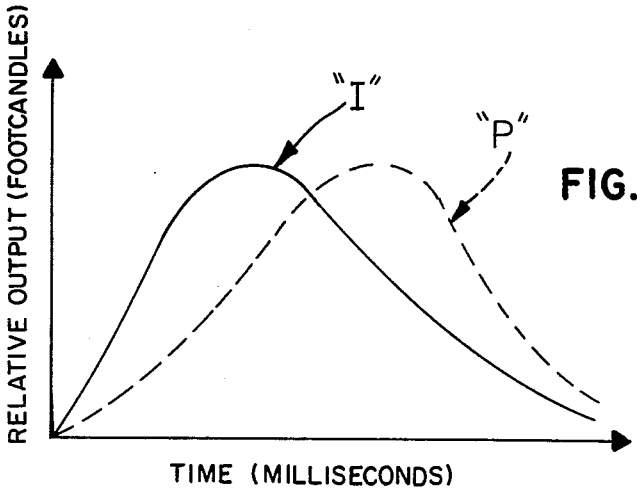
FIG. 2 represents a graph comparing the relative light output versus total ignition time between a photoflash lamp containing the present invention and a photoflash lamp of approximately the same size, but excluding the unique ignition means of the instant invention.

In accordance with the unique teachings herein, ignition means 15 further comprises a second quantity of primer material 19' which is located on a thin member 27 which in turn is positioned at an opposing, second end of envelope 11 from the aforedefined bottom, sealed end 21. In one example of the invention, the second primer material 19' was of the same composition as that of first quantity 19. A similar amount (weight) was also utilized. As shown in FIG. 1, the second quantity of primer material is positioned immediately adjacent (and in physical contact with) the shredded combustible 13 but on an opposing end (31) thereof from the first quantity 19. This material, when ignited by the first primer material 19, in turn serves to ignite the portion of shredded combustible located adjacent thereto. It can be seen, therefor, that first primer 19 almost simultaneously serves to ignite the lowermost portion of shredded combustible as well as the spaced, second quantity of primer material 19'. The second quantity in turn almost instantly serves to ignite the opposing, non-ignited portion of combustible material 13 such that this material burns from opposing ends thereof toward the center and therefor at an accelerated rate over ignition means as typically found in the prior art. This results in an advantageous earlier peak output (see FIG. 2) over a similar lamp not including a second quantity of primer material in the arrangement depicted in FIG. 1. The relative light output (in footcandles) in comparison to the output time (in milliseconds) for the invention is represented by the curve "I". The corresponding relative light output of a similar electrically-activated photoflash lamp not possessing a second primer is represented by the dashed curve "P". In making these comparisons, similar quantities of shredded combustible and first primer material were utilized. In addition, each of the glass envelopes used possessed the same internal volume. It can be readily seen from the graph in FIG. 2. that the relative light output of the instant invention peaks at a substantially earlier period from that of the control model. In addition, photographic prints as produced from cameras utilizing the invention typically possessed fewer, if any, "hot spots" than prints exposed using photoflash lamps such as the control model described above, thus indicating that the resulting light output from the invention is more uniformly distributed over the subject matter being illuminated during exposure of the print negatives.

The thin member 27 used in the invention comprises a substantially cylindrical 0.002 inch thick mica disk having an external diameter of about 0.160 inch. Because this external diameter was about 0.010 inch less than the corresponding internal diameter for the cylindrical envelope 11, disk 27 was substantially loosely positioned atop combustible material 13. The disk was also prevented from upward displacement by the tipped, opposing second end portion 31 of envelope 11. In producing the invention, it is understood that the tipped end 31 is achieved subsequent to insertion of disk 27 and the corresponding second primer 19' within the open second end of the glass tubing which eventually constitutes envelope 11. The first quantity of primer 19 and shredded combustible 13 are previously positioned within this open end, said positioning occuring after the aforementioned sealing of the two lead-in wires 25 within first end 21. Tipping of the glass tubing to provide end 31 can be accomplished using techniques known in the photoflash lamp art. One distinct advantage of the instant invention is that utilization of disk 27 substantially eliminates the possibility of combustible shred material being captured within tip portion 31 during sealing thereof, a common occurrence when tip-sealing subminiature lamp envelopes. Shred material within the second end can adversely affect the seal formed thereat. Understandably, positioning of disk 27 prior to forming the second sealing operation forces substantially all of the shred material downwardly within envelope 11, thus preventing the above undesirable occurrence.

It is within the scope of the invention to utilize a material other than mica for disk 27. For example, it is possible to use an aluminum disk with equal success, said disk possessing substantially the same configuration and dimensions described above. It is also within the scope of the invention to provide a disk of a different configuration than stated, suitable examples being either square or rectangular. A cylindrical configuration is preferred when a corresponding cylindrical-shaped glass envelope is employed. It is even further within the scope of the invention to frictionally insert the primered disk 27 within envelope 11 to provide a more stationary means of positioning said component. This is not necessary in the invention, however, in that the primer and disk members can be loosely positioned as indicated.

Thus there has been shown and described an electrically-activated photoflash lamp including a novel ignition means for providing accelerated ignition of the combustible shred material utilized in the lamp. The improved ignition means further assures more uniform burning of the combustible material to thus provide greater uniformity of output therefrom.

While there have been shown and described what are at present considered the preferred embodiments of the invention, it will be obvious to those skilled in the art that various changes and modifications may be made therein without departing from the scope of the invention as defined by the appended claims.

We claim:

1. In a photoflash lamp including an elongated, light transmitting envelope, a quantity of combustible, light-producing material having a shredded configuration and located within said envelope, and ignition means for igniting said shredded combustible material, the improvement wherein said ignition means includes a first quantity of primer material located within a first end of said envelope adjacent a first portion of said shredded combustible material, a pair of lead-in wires secured within said envelope and electrically connected to said first quantity of primer material for igniting said first quantity of primer material upon application of a suitable pulse across said lead-in wires, a thin member located within a second, opposing end of said envelope from said first quantity of primer material, and a second quantity of primer material positioned on said thin member adjacent a second portion of said shredded combustible material, said first quantity of primer material igniting said second quantity of primer material and said first portion of said shredded combustible material in a substantially simultaneous manner whereupon said second quantity of primer material ignites said second portion of said shredded combustible material to cause said shredded combustible material to burn from said first and second portions toward the center thereof.

2. The improvement according to claim 1 wherein said envelope possesses an internal volume of less than about 0.2 cubic centimeters.

3. The improvement according to claim 1 wherein said combustible material is selected from the group consisting of zirconium and hafnium.

4. The improvement according to claim 1 wherein said thin member comprises a substantially cylindrical disk.

5. The improvement according to claim 1 wherein the material of said thin member is selected from the group consisting of mica and aluminum.

6. The improvement according to claim 1 wherein said first and second quantities of primer material are of substantially the same composition.

7. The improvement according to claim 6 wherein each of said first and second quantities of primer material comprises zirconium and potassium perchlorate.

8. The improvement according to claim 6 wherein said first and second quantities of primer material are of substantially the same weight.

9. The improvement according to claim 1 wherein said first quantity of primer material is positioned on an internal surface of said envelope at said first end thereof, each of said lead-in wires having an end portion substantially flush with said internal surface and in physical contact with said first quantity of primer material.

10. The improvement according to claim 1 wherein said thin member is loosely positioned within said envelope.

11. The improvement according to claim 1 wherein said thin member is frictionally positioned within said envelope.

12. The improvement according to claim 1 wherein said thin member is positioned within said envelope prior to sealing of said second end portion of said envelope, said thin member substantially preventing said shredded combustible material from being contained within said second end portion during said sealing thereof.

* * * * *